United States Patent [19]

Sawada et al.

[11] Patent Number: 4,708,586

[45] Date of Patent: Nov. 24, 1987

[54] THREAD GROOVE TYPE VACUUM PUMP

[75] Inventors: Tadashi Sawada, Akita; Tatsuji Ikegami, Sakai; Masashi Iguchi, Hachioji, all of Japan

[73] Assignees: Rikagaku Kenkyusho, Wako; Osaka Vacuum, Ltd., Osaka, both of Japan

[21] Appl. No.: 896,470

[22] Filed: Aug. 14, 1986

[30] Foreign Application Priority Data

Aug. 14, 1985 [JP] Japan ..... 60-179039
Aug. 14, 1985 [JP] Japan ..... 60-179040
Aug. 14, 1985 [JP] Japan ..... 60-179041

[51] Int. Cl.[4] ..... F04D 3/02
[52] U.S. Cl. ..... 415/72
[58] Field of Search ..... 415/71, 72, 73, 90, 415/76; 416/176, 177

[56] References Cited

U.S. PATENT DOCUMENTS 2,505,386 4/1950 Collins ..... 415/72
3,135,216 6/1964 Peterson ..... 415/72
3,801,214 4/1974 Jonsson ..... 415/72
3,870,433 3/1975 Raikov et al. ..... 415/72
3,912,415 10/1975 Maurice ..... 415/72

FOREIGN PATENT DOCUMENTS 603134 8/1960 Canada ..... 415/72

OTHER PUBLICATIONS

"Rarefied Gas Flow in a Rectangular Groove Facing a Moving Wall", by Tadashi Sawada, Scientific Papers of the Institute of Physical and Chemical Research, Dec. 1976, vol. 70, No. 4.

*Primary Examiner*—Robert E. Garrett
*Assistant Examiner*—Joseph M. Pitko
*Attorney, Agent, or Firm*—Oblon, Fisher, Spivak, McClelland, & Maier

[57] ABSTRACT

A hollow cylindrical stator and a cylindrical rotor are disposed in the stator with a gap therebetween, the inner peripheral surface of the stator or the outer peripheral surface of the rotor being provided with a helical groove, or thread groove, and evacuation being performed by rotation of the rotor. The width of the helical groove adjacent the suction side of the pump is larger than the width of a ridge between adjacent turns of the groove.

3 Claims, 8 Drawing Figures

| | β | ζ | Kv |
|---|---|---|---|
| A | 10 | 4 | 5 |
| B | 10 | 4 | 100 |
| C | 10 | 6 | 5 |
| D | 5 | 4 | 5 |
| E | 20 | 4 | 5 |

THREAD GROOVE TYPE VACUUM PUMP

BACKGROUND OF THE INVENTION

1. Field of the Invention

The present invention relates to a thread groove type vacuum pump suitable for use in forming thin films in the manufacture of integrated circuits, semiconductors and the like.

2. Description of the Related Art

Conventional thread groove type pumps, originally called "molecular drag pumps", have been developed for primary use in the free molecular flow region. In such a pump, which, as shown in FIG. 8, includes a thread groove (4) formed in the outer peripheral surface of a rotor (2) rotably disposed in a stator (1) with a minute gap (3) therebetwen, the width of a ridge (5) between adjacent parts of the groove (4) has been set to be large in order to reduce the rate of leakage flow through the gap (3) and to thereby obtain a high compression ratio.

With the recent progress of industries associated with the application of thin films, such as in the manufacture of integrated circuits and semi-conductors, there has been an increasing demand for development of a vacuum pump which is clean, has a high pumping speed and is capable of being used in a pressure range of from about 1 to 1000 Pa.

However, the conventional thread groove type pumps have had the problem that since the width of the thread groove (4) is small because of the large width of the ridge (5), the pumping speed is very low and, accordingly, the pump cannot be used as a vacuum pump for pumping a large quantity of gas in the aforementioned wide pressure range (1 to 1000 Pa.).

SUMMARY OF THE INVENTION

The present inventors, by dealing with the flow in the thread groove and the flow at the ridge part in simultaneous equations, have acquired an accurate understanding of the flow of gas through the passage between the rotor and the stator, with the rate of leakage flow through the gap taken into account. As a result of such understanding, the inventors have found that by setting the width of the thread groove to be larger and the width of the ridge to be smaller, with a resulting larger cross-sectional area of the groove as compared to a conventional design, it is possible to remarkably increase the flow rate in the axial direction, i.e., the pumping speed.

According to the present invention, there is provided a thread groove type vacuum pump which includes a hollow cylindrical stator and a cylindrical rotor disposed in the stator with a gap therebetween, the inner peripheral surface of the stator or the outer peripheral surface of the rotor being provided with a helical groove or thread groove, and evacuation being performed by rotation of the rotor. The width of the helical groove adjaent the suction side of the pump is larger than the width of a ridge between adjacent turns of the groove.

As a result, the thread groove type vacuum pump of the present invention is capable of pumping a large quantity of gas and creating a wide range of vacuum (1 to 1000 Pa) and is therefore suitable for use in the industrial fields associated with the application of thin films.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
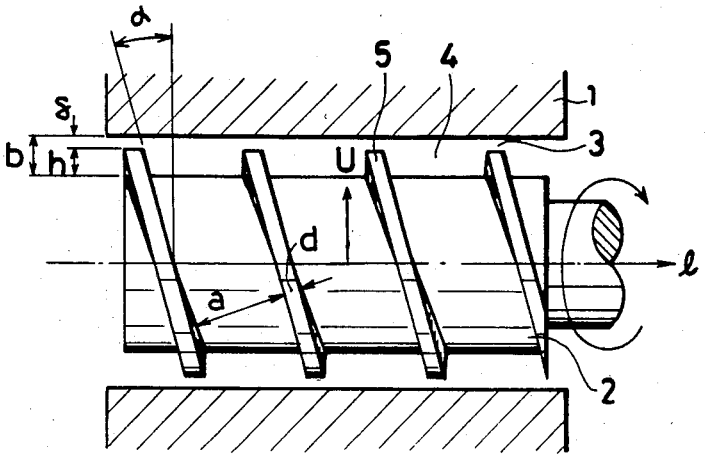
FIG. 1 is a cross-sectional view of an essential part of the thread groove type vacuum pump according to the present invention.
Figure 8:
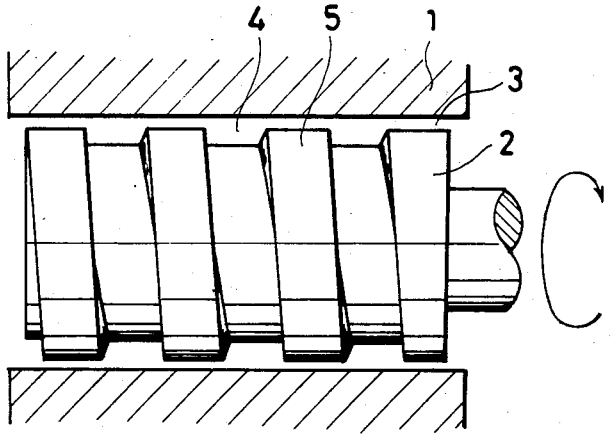
FIG. 8 PRIOR ART
FIG. 8 is a cross section view of an essential part of a prior art thread groove type pump.

An embodiment of the present invention will now be described while referring to FIG. 1.

The thread groove type vacuum pump comprises a hollow cylindrical stator (1) and a rotor (2) disposed in the stator (1) with a gap $\delta$ (3) therebetween, the outer peripheral surface of the rotor (2) being provided with a helical groove (4). For the rotational direction shown in FIG. 1, the suction side of the pump is at the left.

By analyzing in simultaneous equations the flow in the groove (4) and the leakage flow at a ridge (5) between adjacent turns of the groove (4) for the case where the rotor (2) is rotated, the relationship between the dimensionless pressure gradient (hereinafter referred to simply as "pressure gradient") in the axial direction (l-coordinate in FIG. 1) of the rotor (2) and the flow rate in the axial direction is given by $$\frac{1}{\hat{U}} \cdot \frac{dK_v}{d\tilde{l}} = \frac{4}{\sqrt{\pi}} \cdot \frac{1}{\beta} \cdot \frac{F + \frac{1}{\beta}\,\frac{\tilde{W}}{U}\,G\left(\tan\alpha + \frac{1}{\tan\alpha}\right)}{\left(H + \frac{r_p q'_p}{\epsilon}\right)\tan\alpha + \frac{r_p q'_p}{\epsilon \tan\alpha}} \qquad \text{(i)}$$

where $K_v$: a quantity proportional to pressure, $K_v = \delta/\lambda$, which is calculated from the mean free path of the gas, $\lambda$, and the gap $\delta$; hereinafter, referred to as "dimensionless pressure", $\tilde{l}$: dimensionless axial length, $\tilde{l} = l/b$, where l is axial length and b is the sum of the gap $\delta$ and the groove depth h, $\hat{U}$: dimensionless circumferential velocity of rotor, $\hat{U}=U/\sqrt{2RT/M}$, where U is circumferential velocity of rotor, R is the universal gas constant, T is the absolute temperature and M is molecular weight of the gas, $\widetilde{W}$: dimensionless flow rate, $\widetilde{W}=Q/\sqrt{\pi}\mu K_v$, where Q is the flow rate of the gas and $\mu$ is the viscosity of gas, $\alpha$: inclination angle of thread groove, $\beta$: gap factor, $\beta=(\delta+h)/\delta=b/\delta$, $\epsilon$: groove width factir, $\epsilon=a/(a+d)$, where a is groove width and d is ridge width, $\xi$: groove cross section factor, $\xi=a/(\delta+h)=a/b$, $$F = -(1-\epsilon)\left\{ q'_p(q_v + q'_v - r_v) + r_p\left(\frac{\epsilon}{1-\epsilon}\cdot q_v - q'_v + r_v\right)\right\},$$

$$G = \frac{1-\epsilon}{\epsilon} q'_p + r_p$$

$$H = (1-\epsilon)\left\{ q'_p(q_p + q'_p) + r_p\left(\frac{\epsilon}{1-\epsilon} q_p - 2q'_p + r_p\right)\right\}$$

where $q_v$, $q'_v$, $r_v$, $q_p$, $q'_p$, and $r_p$ are each a function of a geometric parameter and pressure, that is, $$r_v = \frac{1}{2\beta},\ r_p = -\frac{\frac{1}{K_v}+\frac{1}{6}}{\beta^3}$$

and $q_p$, $q'_p$, $q_v$ and $q'_v$ are presented in the paper entitled "Rarefied Gas Flow in a Rectangular Groove Facing a Moving Wall" in Scientific Papers of the Institute of Physical and Chemical Research, Vol. 70, No. 4 (Dec., 1976).

Next, Eq. (i) is differentiated with respect to the inclination angle of thread groove $\alpha$, and by using $$\frac{\partial}{\partial\alpha}\left(\frac{dK_v}{d\bar{l}}\right) = 0.$$

The optimum value $\alpha_{op}$ of $\alpha$ which maximizes the pressure gradient $dK_v/d\bar{l}$ is given by $$\alpha_{op} = \tan^{-1}\left\{\frac{-\frac{GH}{F}\cdot\frac{\widetilde{W}}{\beta\hat{U}} + \sqrt{\left(\frac{GH}{F}\cdot\frac{\widetilde{W}}{\beta\hat{U}}\right)^2 + \left(H+\frac{r_p q'_p}{\epsilon}\right)\cdot\frac{r_p q'_p}{\epsilon}}}{H+\frac{r_p q'_p}{\epsilon}}\right\} \quad \text{(ii)}$$

For a given dimensionless pressure $K_v$ and for various values of the geometric parameters $\xi$, $\epsilon$ and $\beta$, the optimum inclination angle of thread groove, $\alpha_{op}$, which maximizes the pressure gradient is obtained by Eq. (ii), and the pressure gradient corresponding to the $\alpha_{op}$ can be obtained by Eq. (i).

Figure 2:
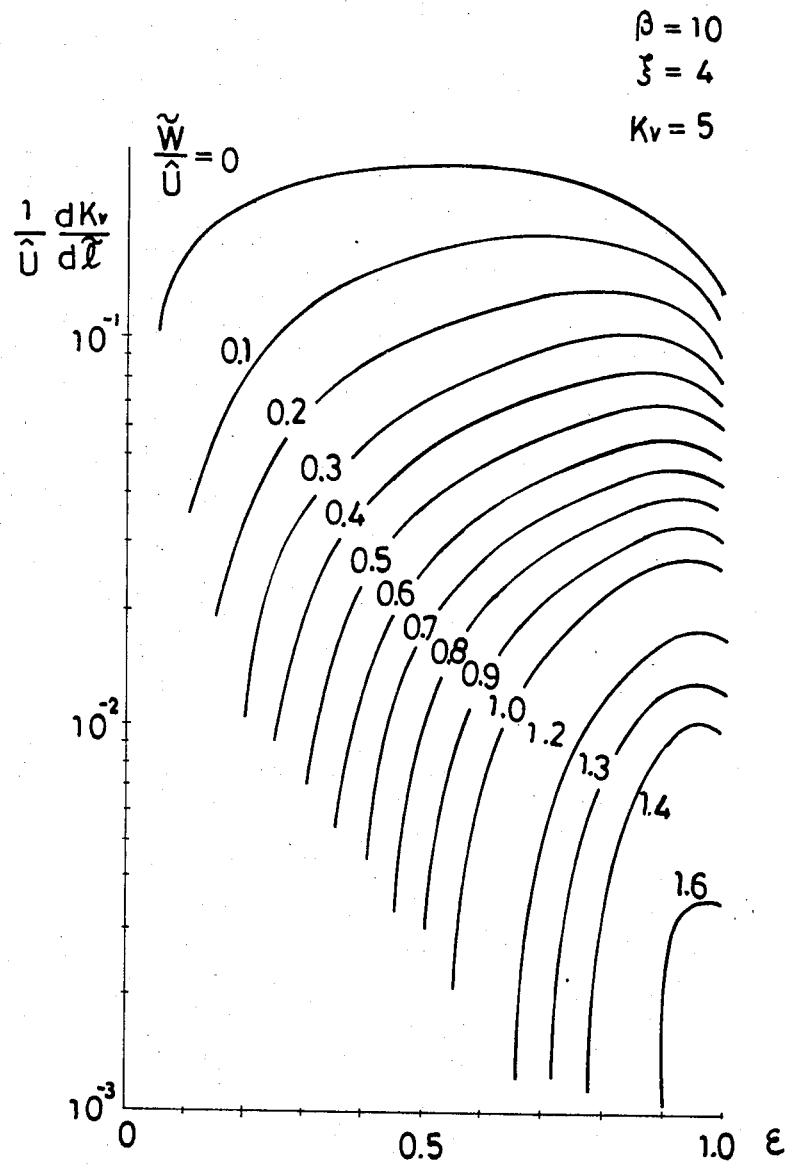
FIG. 2 is a graph showing the relationship between a geometric parameter $\epsilon$ and pressure gradient at various levels of flow rate.

FIG. 2 shows the variations of pressure gradient with the geometric parameter $\epsilon$ at various levels of flow rate, for the case where the two geometric parameters $\xi$ and $\beta$ and the dimensionless pressure $K_v$ are fixed.

From FIG. 2 it is seen that there is a value of $\epsilon$ which maximizes the pressure gradient at each level of flow rtae.

Such a value of $\epsilon$ is termed $\epsilon_{op}$, and the $\epsilon_{op}$ at each level of flow rate was obtained in FIG. 2. The relationship between the flow rate and $\epsilon_{op}$ is shown by A in FIG. 3.

Figure 3:
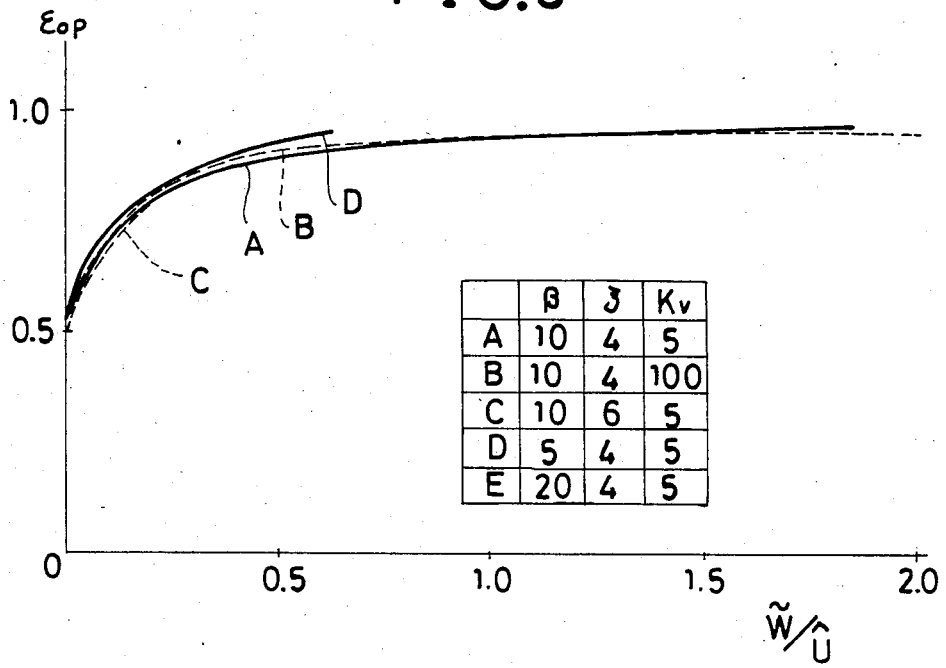
FIG. 3 is a graph showing the relationships between flow rate and $\epsilon_{op}$ (the optimum value of $\epsilon$) for a variety of sets of values of geometric parameters.
Figure 4:
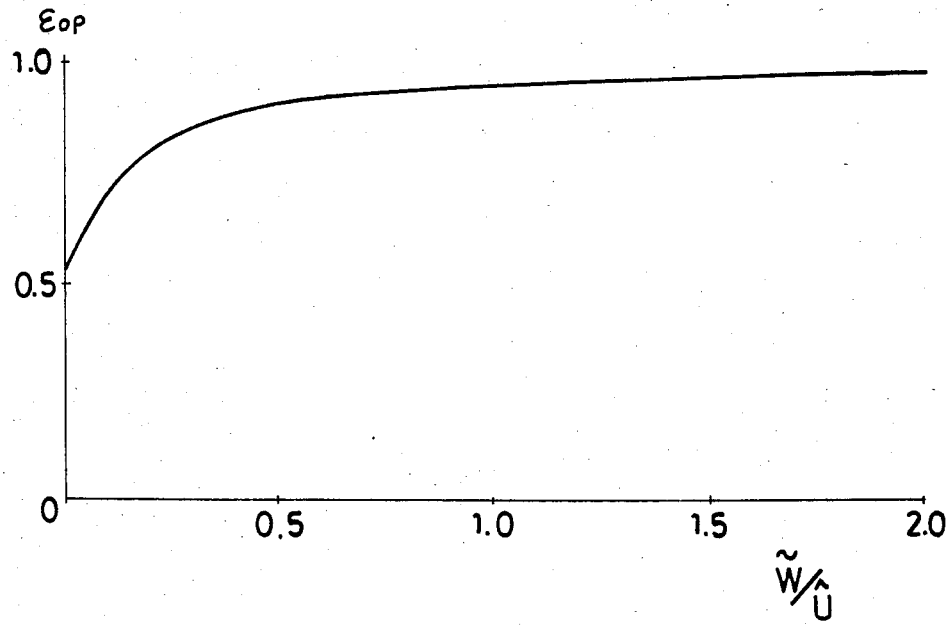
FIG. 4 is a graph showing the relationship between flow rate and $\epsilon_{op}$.

FIG. 3 also shows the variations of $\epsilon_{op}$ with the other geometric parameters $\xi$ and $\beta$ and the dimensionless pressure $K_v$. It is seen from FIG. 3 that the relationship between the flow rate and $\epsilon_{op}$ may be considered to be independent of the other geometric parameters $\xi$ and $\beta$ or the pressure $K_v$, and to be uniquely given by FIG. 4.

The pumping performance required of the thread groove type vacuum pump in the aforementioned industrial fields associated with the application of thin films, in terms of pumping speed for a rotor diameter of 200 mm and a rotating frequency of 24000 rpm, is from 50 to 300 liter/sec, at least not lower than 50 liter/sec. In this case, $\widetilde{W}/\hat{U}$ at the suction port is not less than 0.2, and it is seen from FIG. 4 than $\epsilon_{op}$ at the suction port is preferably not less than 0.8. In addition, FIG. 2 shows that the pressure gradient $1/\hat{U}\cdot dK_v/d\bar{l}$ decreases with an increase in $\widetilde{W}/\hat{U}$, and the desired degree of vacuum cannot be obtained when $1/\hat{U}\cdot dK_v/dl$ is less than $1.4\times10^{-2}$. For the pressure gradient $1/\hat{U}\cdot dK_v/d\bar{l}$ to be not less than $1.4\times10^{-2}$, as seen from FIG. 2, the flow rate $\widetilde{W}/\hat{U}$must be not more than 1.3, and the curves for higher levels of the flow rate $\widetilde{W}/\hat{U}$ do not have a point at which the pressure gradient $1/\hat{U}\cdot dK_v/d\bar{l}$ reaches $1.4\times10^{-2}$. It is seen from FIG. 4 that $\epsilon_{op}$ satisfying this condition is preferably not more than 0.95. Thus, $\epsilon_{op}$ is preferably from 0.8 to 0.9.

Further, in view of the fact that gas in the vacuum pump is gradually compressed as the gas flows from the suction side toward the discharge side, the pump may be designed so that an $\epsilon$ value of from 0.8 to 0.95 is secured on the suction side and $\epsilon$ is gradually reduced downstream, namely, in the direction toward the discharge side.

Figure 5:
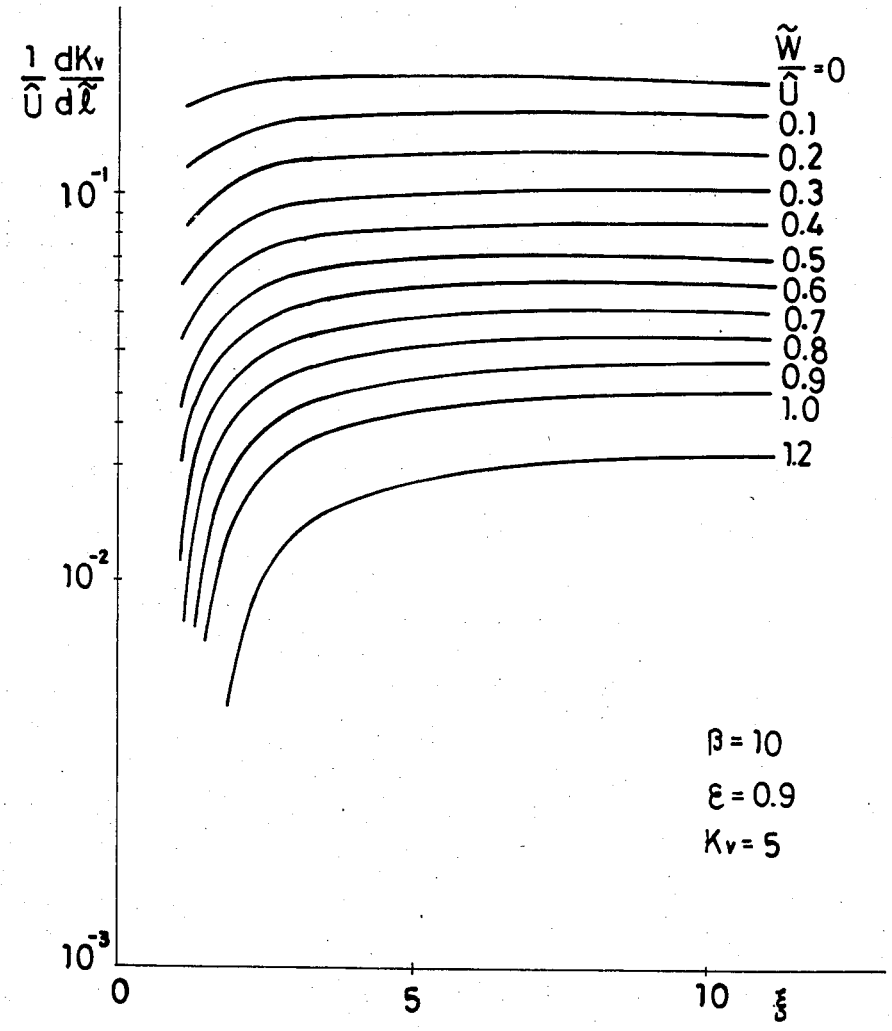
FIG. 5 is a graph showing the relationship between a geometric parameter $\xi$ and pressure gradient.

FIG. 5 shows the variation of the pressure gradient $1/\hat{U}\cdot dK_v/d\bar{l}$ with the geometric parameter $\epsilon$ at various levels of flow rate for the case where the two geometric parameters $\epsilon$ and $\beta$ and the dimensional pressure $K_v$ are fixed. It is seen from FIG. 5 that the larger the parameter $\xi$, the higher the pressure gradient. This tendency applies also to combinations other than the combination of $\beta=10$, $\epsilon=0.9$ and $K_v=5$.

In addition, though the pressure gradient $1/\hat{U}\cdot dK_v/d\bar{l}$ increases with an increase in $\xi$, when $\xi$ reaches or exceeds a certain value, the increase in the pressure gradient $1/\hat{U}\cdot dK_v/dl$ becomes minimal, and the increase depends on the flow rate.

This shows that it is not preferable to try it increase the suction cross section by securing a larger width of the ridge (5) while reducing the width a of the groove (4) and increasing the depth h of the groove (4), since such an approach leads to smaller $\xi$ and a decreased pressure gradient. It is therefore preferable to set the width a of the groove (4) to be large.

The pumping performance required of the thread groove type vacuum pump in the aforementioned industrial field is a pumping speed of from 50 to 300 liter/sec for a rotor diameter of 200 mm and a rotating frequency of 24000 rpm. In this case, $\hat{W}/\hat{U}$ at the suction port is from 0.2 to 1.2. In addition, if the pressure gradient $1/\hat{U}\cdot dK_v/d\bar{l}$ is less than $1.4\times10^{-2}$, the pumping performance displayed in practical use is too low to obtain the desired degree of vacuum. Therefore, it is necessary to hve a $\xi$ value of at least 3, which is the $\xi$ value at the intersection of a line of a pressure gradient of $1.4\times10^{-2}$ and a curve of $\hat{W}/\hat{U}=1.2$ in FIG. 5. However, setting the value of $\xi$ to be large makes it necessary to reduce correspondingly the width of the ridge (5), and when $\xi$ is more than 6, the width of the ridge (5) is so small and the strength of the ridge (5) is so low that the ridge (5) may be broken in the practical use of the pump; such a design is unfavorable. Therefore, the value of $\xi$ is preferably set in the range of from 3 to 6.

Next, with the following definitions $K_I$: a quantity proportional to pressure, $K_I=b/\lambda$, where $\lambda$ is the mean free path of gas and b is the sum of the groove depth h and the gap $\delta$; hereinafter, referred to "dimensionless pressure", : dimensionless flow rate, $\hat{W}=Q/\sqrt{\pi}\bar{\mu}K_I$, where Q is flow rate and $\mu$ is the viscosity of gas, Eq. (i) is rewritten as follows:

$$\frac{1}{U}\cdot\frac{dK_1}{d\bar{l}}=\frac{4}{\sqrt{\pi}}\cdot\frac{F+\frac{\hat{W}}{\hat{U}}G\left(\tan\alpha+\frac{1}{\tan\alpha}\right)}{\left(H+\frac{r_pq'_p}{\epsilon}\right)\tan\alpha+\frac{r_pq'_p}{\epsilon\tan\alpha}} \quad \text{(iii)}$$

By differentiating Eq. (iii) with respect to the inclination angle of thread groove, $\alpha$, and using $$\frac{\partial}{\partial\alpha}\left(\frac{dK_1}{d\bar{l}}\right)=0$$

the optimum value $\alpha_{op}$ of the inclination angle $\alpha$ which maximizes the pressure gradient $1/\hat{U}\cdot dK_I/d\bar{l}$ is given as $$\alpha_{op}=\tan^{-1}\left\{\frac{-\frac{GH}{F}\cdot\frac{\hat{W}}{\beta U}+\sqrt{\left(\frac{GH}{F}\cdot\frac{\hat{W}}{\beta\hat{U}}\right)^2+\left(H+\frac{r_pq'_p}{\epsilon}\right)\cdot\frac{r_pq'_p}{\epsilon}}}{H+\frac{r_pq'_p}{\epsilon}}\right\} \quad \text{(iv)}$$

For a given dimensionless pressure $K_I$ and for various values of the geometric parameters $\xi$, $\epsilon$ and $\beta$, the optimum inclination angle $\alpha_{op}$ is given by Eq. (iv), and the pressure gradient corresponding to the $\alpha_{op}$ can be obtained by Eq. (iii).

Figure 6:
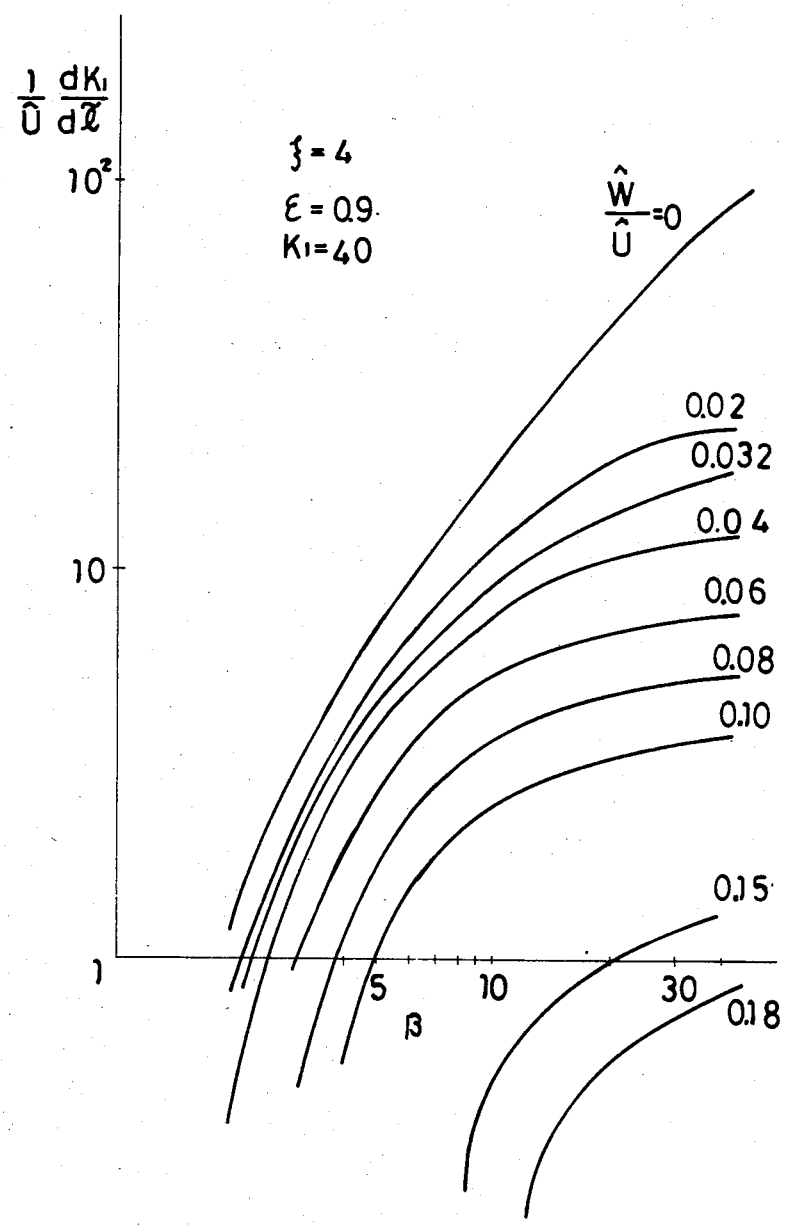
FIG. 6 is a graph showing the relationship between a geometric parameter $\beta$ and pressure gradient at various levels of flow rate.

FIG. 6 shows the variation of the pressure gradient $1/\hat{U}\cdot dK_I/d\bar{l}$ with the geometric parameter $\beta$ at various levels of flow rate for the case where the geometric parameters $\xi$ and $\epsilon$ and the dimensionless pressure $K_I$ are fixed. It is seen from FIG. 6 that the larger the parameter $\beta$, the greater the pressure gradient $1/\hat{U}\cdot dK_I/d\bar{l}$. This tendency applies also to combinations other than the combination of $\xi=4$, $\epsilon=0.9$ and $K_I=40$.

Figure 7:
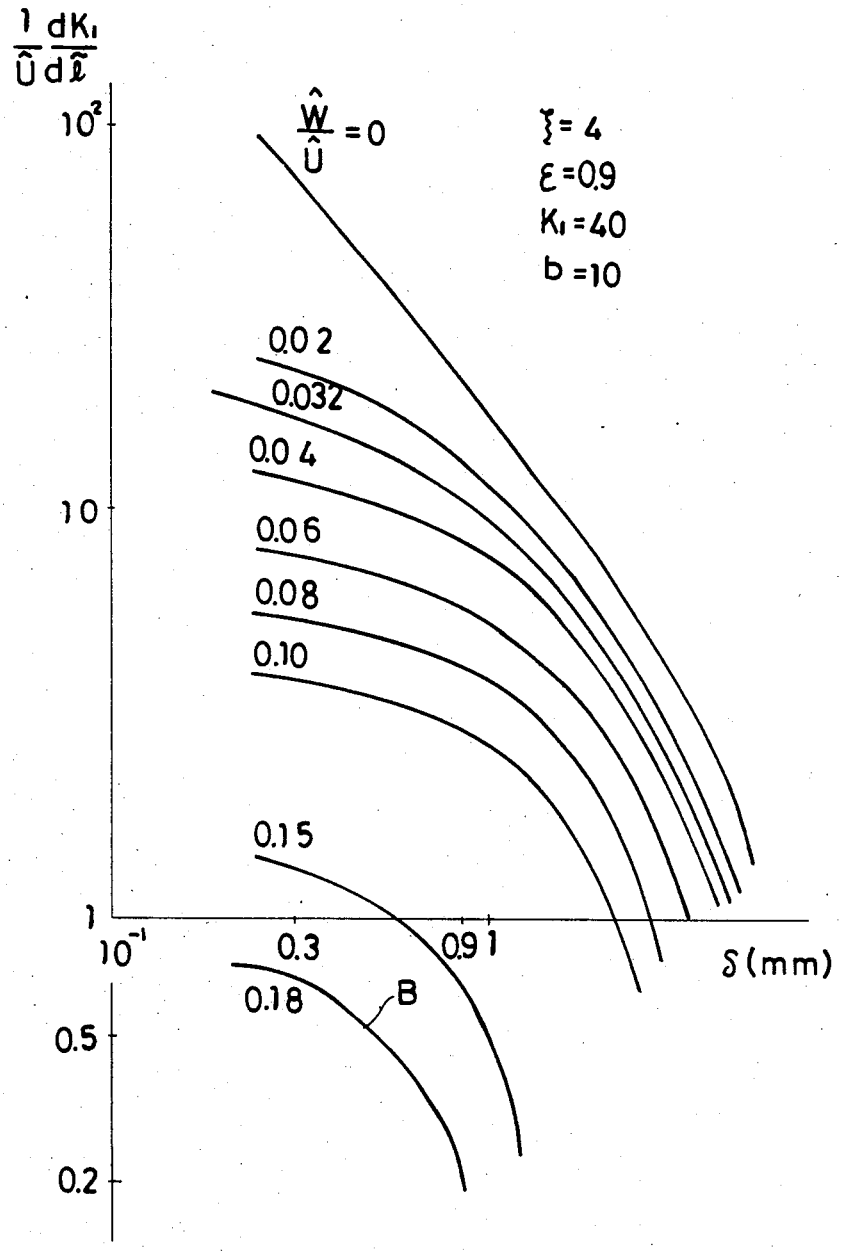
FIG. 7 is a graph showing the relationship between the gap $\delta$ and pressure gradient at various levels of flow rate.

FIG. 7 shows a graph obtained by assuming the reference length b to be 10 mm and rewritting FIG. 6 by changing the abscissa from $\beta$ to the gap $\delta$.

It is seen from FIG. 7 that the pressure gradient $1/\hat{U}\cdot dK_I/d\bar{l}$ increases with a decrease in $\delta$, but when there is flow rate, if low, the increase in the pressure gradient becomes inconspicious when $\delta$ decreases below a certain value.

The pumping performance required of the thread groove type vacuum pump in the aforementioned industrial fields is a pumping speed of from 50 to 300 liter/sec for a rotor diameter of 200 mm and a rotating frequency of 24000 rpm. In this case, $/\hat{U}$ at the suction port is from 0.032 to 0.18. On the other hand, the desired degree of vacuum cannot be obtained when the pressure gradient $1/\hat{U}\cdot dK_I/d\bar{l}$ is below 0.2. Therefore, the upper limit of $\delta$ is 0.9 mm, which is the $\delta$ value at the intersection of a curve B of $/\hat{U}=0.18$ and a line of $$\frac{1}{U}\cdot\frac{dK_I}{d\bar{l}}=0.2.$$

In addition, when $/\hat{U}$ is more than 0.032, the increase in the pressure gradient is not conspicuous even if $\delta$ is decreased below 0.3 mm, and an additional danger of contact of the rotor and the stator due to thermal expansion of the rotor arises. Accordingly, the lower limit of $\delta$ is 0.3 mm.

Here, these values of $\delta$ are in operation. When a rotor consisting of an aluminum alloy cylinder of 200 mm in outer diameter rotates at 24000 rpm, a centrifugal expansion reaches 0.4 mm in diameter, or 0.2 mm in radius, as above mentioned. Therefore, the $\delta$ value as measured when the rotor is stationary, $\delta_0$, is preferably in the range of from $0.3+0.2=0.5$ to $0.9+0.2=1.1$. Accordingly, since the rotor diameter is 200 mm, the gap $\delta_0$ in the stationary condition is preferably in the range of from $0.5/200=0.0025$ times to $1.1/200=0.0055$ times the rotor diameter. Though the above description applies to the case where the rotor diameter is 200 mm, a similar relationship of the diameter and the gap exists also in cases where the rotor diameter is not equal to 200 mm and, accordingly, it is preferable in any case that the $\delta_0$ in the stationary condition is in the range of from 0.0025 to 0.0055 times the rotor diameter.

As stated above, even when the gap as measured when the rotor is stationary is enlarged to from 0.0025 to 0.0055 times the rotor diameter, a large quantity of gas can be pumped in a wide pressure range (1 to 1000 Pa), and there is no danger of contact of component parts arising from suction of solid matter, elongation of the rotor due to centrifugal force generated at the time of high-speed rotation or the thermal expansion of the component parts. In addition, strict accuracy of machining is not required in the manufacture of the pump.

The present invention is applicable not only to the abovementioned thread groove type vacuum pump consisting only of the thread groove molecular pump part but also to a thread groove molecular pump part of a compound molecular pump comprising a turbomolecular pump part and a thread groove molecular pump part as one body.

Obviously, numerous modifications and variations of the present invention are possible in light of the above teachings. It is therefore to be understood that within the scope of the appended claims, the invention may be practices otherwise than as specifically described herein.

What is claimed as new and desired to be secured by Letters Patents of the United States is:

1. A thread groove type vacuum pump for a gas, comprising:

a hollow cylindrical stator;

a cylindrical rotor disposed in said stator with a gap therebetween;

a helical or thread groove formed on one of the inner peripheral surface of said stator and the outer peripheral surface of said rotor; and means for rotating said rotor whereby evacuation is performed between a suction side and a discharge side of said pump, wherein a width of said groove adjacent said suction side is larger than a width of a ridge between adjacent turns of said groove, and wherein said width of said groove adjacent said suction side is from 0.8 to 0.95 times the sum of said width of said groove and said width of said ridge between adjacent turns of said groove, whereby a pressure gradient of the gas between said suction side and said discharge side is maximized for a wide range of flow rates of the gas.

2. A vacuum pump according to claim 1, wherein the ratio of the sum of the depth of said groove adjacent said suction side and said gap to said width of said groove is from 1/6 to $\frac{1}{3}$.

3. A vacuum pump according to claim 1, wherein said gap as measured when said rotor is stationary is from 0.0025 to 0.0055 times the diameter of said rotor.

* * * * *

UNITED STATES PATENT AND TRADEMARK OFFICE

CERTIFICATE OF CORRECTION

PATENT NO. : 4,708,586

DATED : November 24, 1987

INVENTOR(S) : TADASHI SAWADA ET AL

It is certified that error appears in the above-identified patent and that said Letters Patent is hereby corrected as shown below:

Column 1, line 17, change "rotably" to --rotatably--.

Column 1, line 18, change "therebetwen" to --therebetween--.

Column 1, line 61, change "adjaent" to --adjacent--.

Column 2, line 53, change "$=\frac{4}{\sqrt{\pi}}\cdot\frac{1}{\beta}$" to --$=\frac{4}{\sqrt{\pi}}\cdot\frac{1}{\beta_2}$--.

Column 3, line 11, change "factir" to --factor--.

Column 4, line 21, change "than" to --that--.

Column 4, line 24 change "$W/\hat{U}$" to --$\tilde{W}/\hat{U}$--.

Column 4, line 25, change "$1/\hat{U}\cdot dKv/\tilde{d}l$" to --$1/\hat{U}\cdot dK_V/d\tilde{l}$--.

Column 4, line 42, change "parameterε" to --parameterζ--.

Column 4, line 62, change "$1/\hat{U}\cdot dKv/dl$"to --$1/\hat{U}\cdot dKv/d\tilde{l}$--.

UNITED STATES PATENT AND TRADEMARK OFFICE

CERTIFICATE OF CORRECTION

PATENT NO. : 4,708,586

DATED : November 24, 1987

INVENTOR(S) : TADASHI SAWADA ET AL

It is certified that error appears in the above-identified patent and that said Letters Patent is hereby corrected as shown below:

Column 5, line 12, change "hve" to --have--.

Column 5, line 27, change ":dimensionless" to --$\hat{W}$:dimensionless--.

Column 6, line 7, change "inconspicious" to --minimal--.

Column 6, line 13, change "/$\hat{U}$" to --$\hat{W}$/$\hat{U}$--.

Column 6, line 18, change "/$\hat{U}$" to --$\hat{W}$/$\hat{U}$--.

UNITED STATES PATENT AND TRADEMARK OFFICE

CERTIFICATE OF CORRECTION

PATENT NO. : 4,708,586

DATED : November 24, 1987

INVENTOR(S) : TADASHI SAWADA ET AL

It is certified that error appears in the above-identified patent and that said Letters Patent is hereby corrected as shown below:

Column 6, line 20, change "$\frac{1}{U} \cdot \frac{dK_1}{d\tilde{l}} = 0.2$." to --$\frac{1}{\hat{U}} \cdot \frac{dK_1}{d\tilde{l}} = 0.2$--.

Column 6, line 23, change "/$\hat{U}$" to --$\hat{W}/\hat{U}$--.

Column 7, line 9, change "practices" to --practiced--.

Column 7, line 11, change "Patents" to --Patent--.

Signed and Sealed this

Twenty-first Day of March, 1989

*Attest:*

*Attesting Officer*

DONALD J. QUIGG

*Commissioner of Patents and Trademarks*